US007343888B1

(12) United States Patent
VanValkenburgh

(10) Patent No.: US 7,343,888 B1
(45) Date of Patent: Mar. 18, 2008

(54) SPRINGLESS VALVE SYSTEM

(75) Inventor: Charles N VanValkenburgh, Huntsville, AL (US)

(73) Assignee: Pit Bull Products, Inc., Huntsville, AL (US)

( * ) Notice: Subject to any disclaimer, the term of this patent is extended or adjusted under 35 U.S.C. 154(b) by 0 days.

(21) Appl. No.: 11/463,603

(22) Filed: Aug. 10, 2006

(51) Int. Cl.
*F01L 1/30* (2006.01)

(52) U.S. Cl. ..... 123/90.26; 123/90.24; 123/90.25; 123/90.48

(58) Field of Classification Search ..... 123/90.25, 123/90.26, 90.48, 90.5, 90.24
See application file for complete search history.

(56) References Cited

U.S. PATENT DOCUMENTS 1,084,514 A * 1/1914 Whitlock ..... 123/87

* cited by examiner

*Primary Examiner*—Zelalem Eshete
(74) *Attorney, Agent, or Firm*—Adam K. Sacharoff; Much Shelist

(57) ABSTRACT

A poppet valve actuation system utilizing separate opening and closing cams that press against opening and closing cam followers, respectively. The opening and closing cam followers are linked to each other directly by a tension member so they move in unison. The valve is firmly connected to the opening cam follower. The opening and closing cam followers and valve are all collinear when viewed from the end of the cam shaft.

18 Claims, 5 Drawing Sheets

SPRINGLESS VALVE SYSTEM

FIELD OF THE INVENTION

The present invention relates generally to valve systems for internal combustion engines. More particularly, this invention pertains to a poppet valve actuation system for internal combustion engines.

BACKGROUND OF THE INVENTION

Most prior internal combustion, such as a four-stroke piston engines, use an opening cam to open the valve, but use heavy spring(s) to close the valve. Though there are many detailed variations to how prior systems are implemented, the cam and valve are generally either linked directly whereby the cam presses directly on the valve or via rocker arms where the cam is generally not situated directly over the valve.

Disadvantages of the heavy spring system are: i) heavy spring loading creates more work for the engine thus robbing horsepower, ii) valves are able to "float" (i.e., not follow the valve profile closely) at high RPM, and iii) if the cam is situated directly over the valve, the heavy spring system generally requires removal of the camshaft for valve adjustment.

Since 1956, Ducati Motorcycles have used opening and closing cams with separately articulating rocker arms to indirectly link the cams to the poppet valve in an offset fashion. In the Ducati system, the cam is not situated directly over the valve and thus the cam is not collinear with the valve stem. The Ducati system also requires a spring (relatively small compared to conventional internal combustion, piston engines) to do final valve closing/sealing. The Ducati spring is actuated through the entire valve travel. Disadvantages of the Ducati system include: i) more reciprocating mass created by the rocker arms, ii) complex valve adjustment procedures relative to the present invention, and iii) a spring (rotary, or torsion) used for final valve closing/sealing increases force proportionately with valve travel.

The embodiments of the present invention pertain to a poppet valve actuation system for internal combustion engines that uses a cam to open the valve and a cam to close the valve with cam followers linked directly with a tension member and without additional articulating members, commonly known as rocker arms. The size and proportions of the system and its components can be altered to fit various applications. This invention was developed for internal combustion engines but can be applied to any system requiring controlled, cam-driven reciprocation of an element.

BRIEF SUMMARY OF THE INVENTION

The present invention is a poppet valve actuation system that opens and closes the valve for internal combustion, four stroke engines. It is distinguished from most valve systems in that it operates without the use of a heavy valve spring to return the valve to its closed position. It is distinguished from the Ducati system in that it operates without the use of offset, articulating arms commonly known as rocker arms. Instead, it uses separate opening and closing cam lobes that actuate their respective cam followers by pressing on the cam followers. The cam followers are directly linked to each other and to the valve. The system causes the valve to reciprocate in a linear path from the open to the closed position. Final valve closing may be accomplished with a small, short travel spring that is only actuated during the period when the system is not capable of positive actuation due to valve clearance that must be built-in to prevent damage. The result is a system that is relatively simple to manufacture and to adjust. It has minimal reciprocating mass and is not hampered by heavy springs. It should improve engine performance by allowing high revolutions without valve float and should allow further weight reductions in the cam and cam drive since it requires less force to operate than previous systems.

The present invention has potential for wide spread applications in that it can be incorporated into virtually all current and future internal combustion, four stroke engine designs, or any system requiring controlled, cam-driven reciprocation of an element. Other details and advantages of the present system are apparent in the following description, accompanying drawings and the claims.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
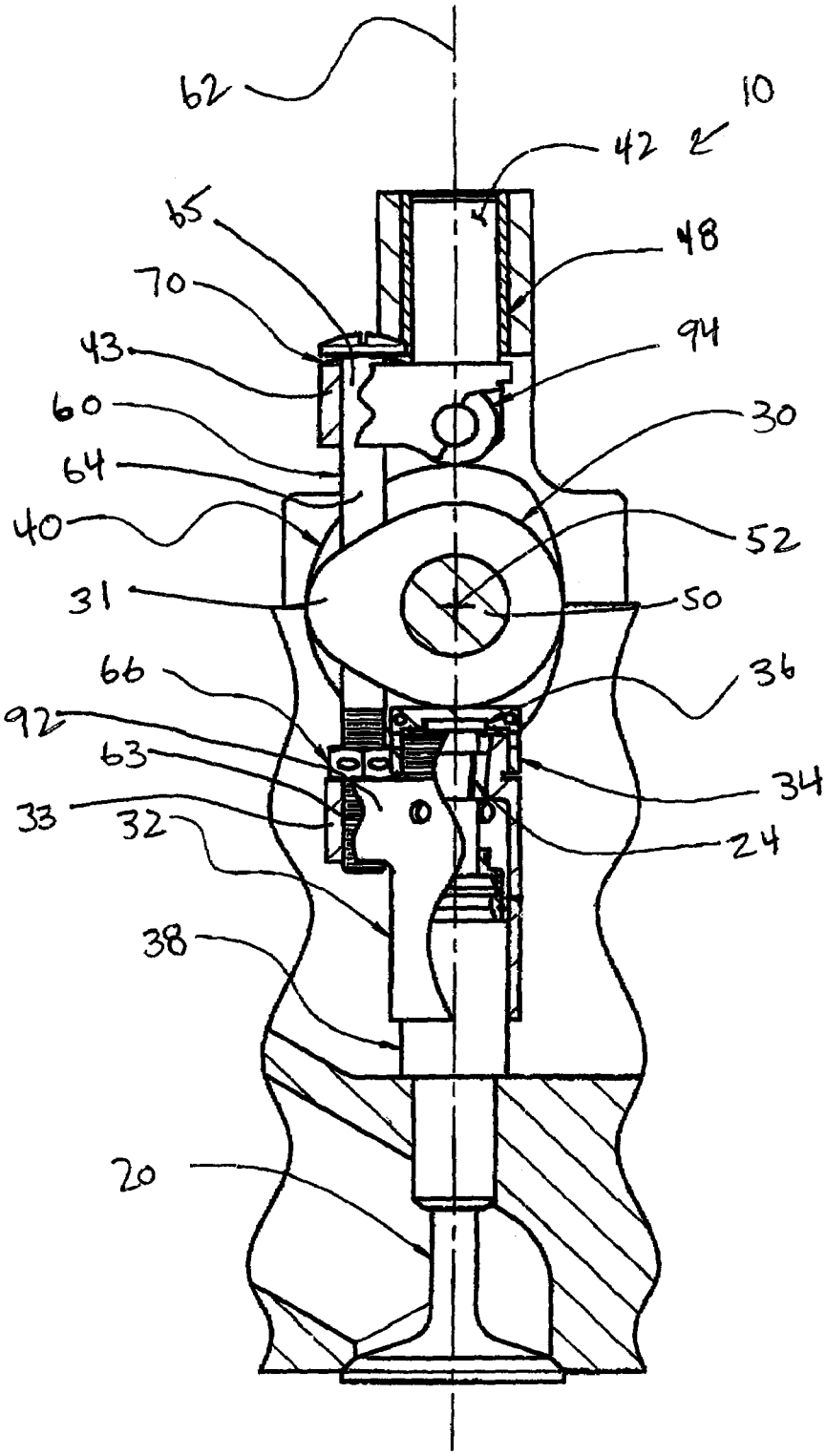
FIG. 1 is a partial sectional view illustrating the cam shaft and valve system components and the linear relationship of the cam followers and valve in accordance to an embodiment of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
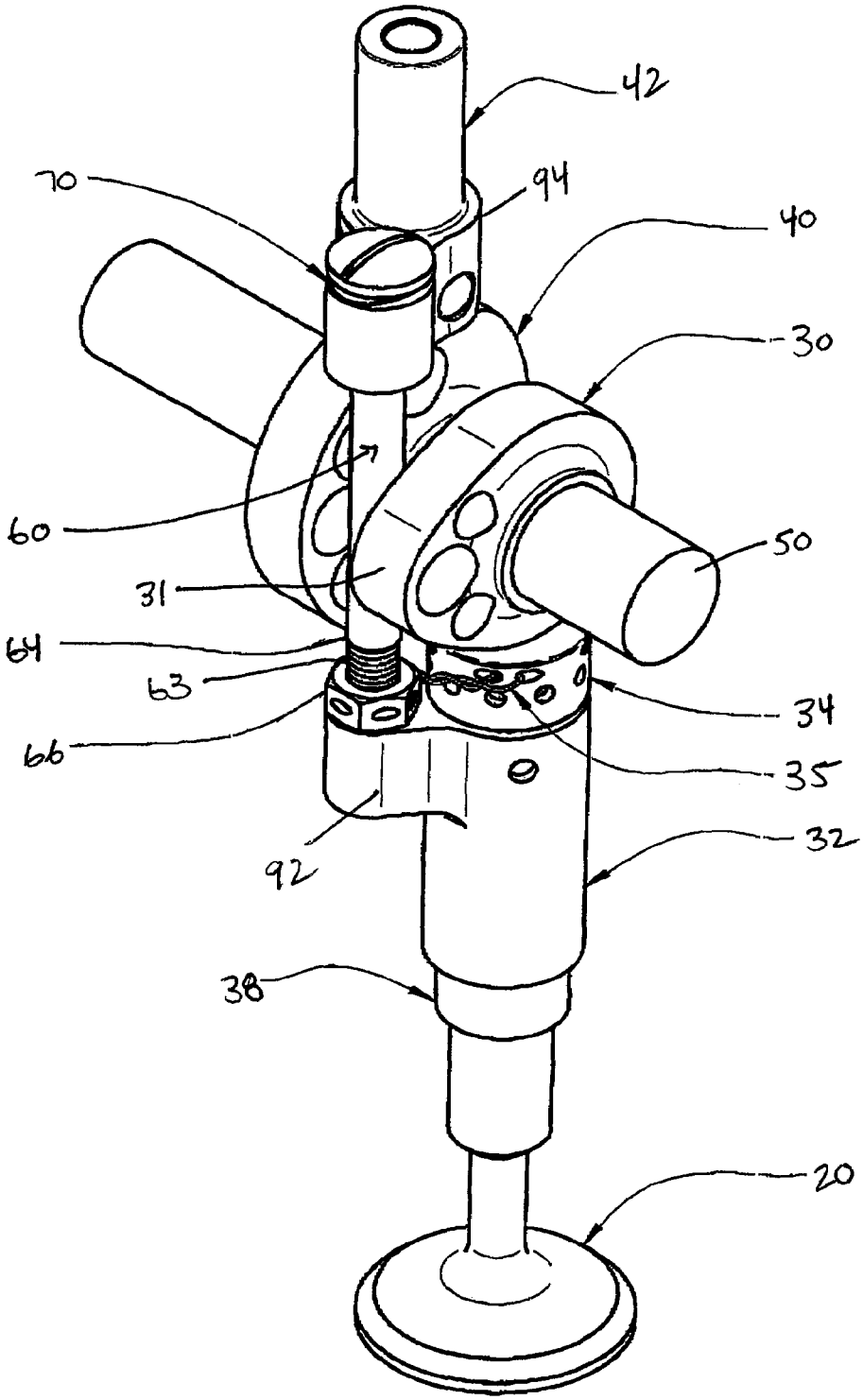
FIG. 2 is a perspective view showing the springless valve system in accordance to an embodiment of the present invention.
Figure 3:
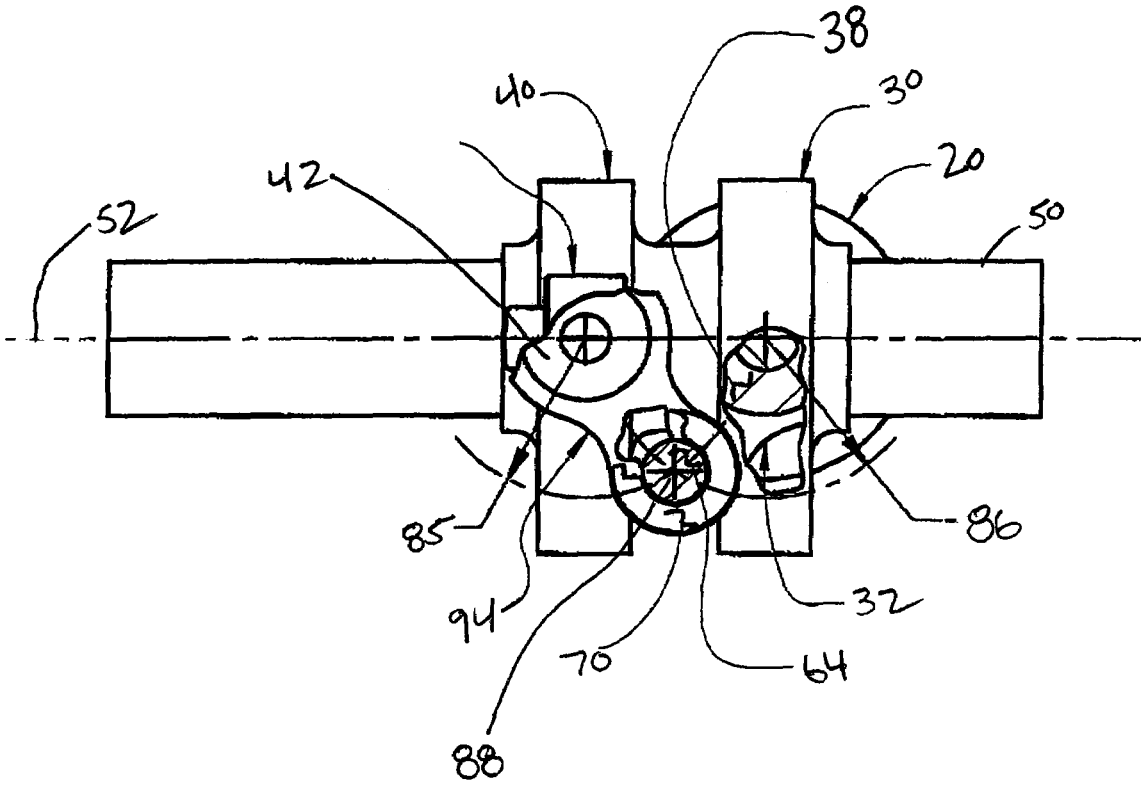
FIG. 3 is a top partial sectional view of the valve illustrating the offset relationship of the cam followers and tension rod.

The present invention is for use in internal combustion, four-stroke piston engines. Referring now to FIGS. 1-3, there is shown a springless valve system 10, which includes a conventional poppet valve 20 with an opening cam 30 to open the valve 20 and a closing cam 40 to close the valve 20. The opening and closing cams, 30 and 40 respectively, are mounted on a cam shaft 50 that is driven to rotate such that the cams rotate.

Two cam followers, an opening cam follower 32 and a closing cam follower 42, are directly linked to each other and connected to the valve 20 such that the opening cam 30 and closing cam 40 work in concert to move the valve 20 into open and closed positions directly. The opening and closing cams (30 and 40) press directly on the respective cam followers (32 and 42) to directly act on the valve 20.

The two cam followers 32 and 42 are connected to each other by an elongated member 60. The elongated member 60 is in this embodiment positioned substantially parallel to the centerline 62 of the valve shaft. The elongated member 60 is a tension rod 64 that can be tightened or loosened as desired for performance.

The tension rod 64 is secured into offset flanges provided in both the opening cam follower 32 and the closing cam follower 42. The tension rod 64 is threaded on one end, which is secured by a locking nut 66 against an offset flange 92 defined by the opening cam follower 32. This flange 92 includes a threaded hole 33 for receiving the threaded end 63. The closing cam follower 42 has an offset flange 94 with a smooth bored hole 43 to receive the opposite end 65 of the tension rod 64 and allow longitudinal movement with respect to the closing cam follower 42 (regulated by a short spring 70). Thus the opposite end 65 of the tension rod 64 is able to slide within the smooth bored hole 43.

The valve 20 is firmly locked to the opening cam follower 32 by a cam cap 34. Other component parts that may be included therewith are cam shims 36, valve keepers 24, opening cam follower guide 38, and closing cam follower guide 48. The functions of which are well known in the industry such that further reference is not necessary.

Figure 4:
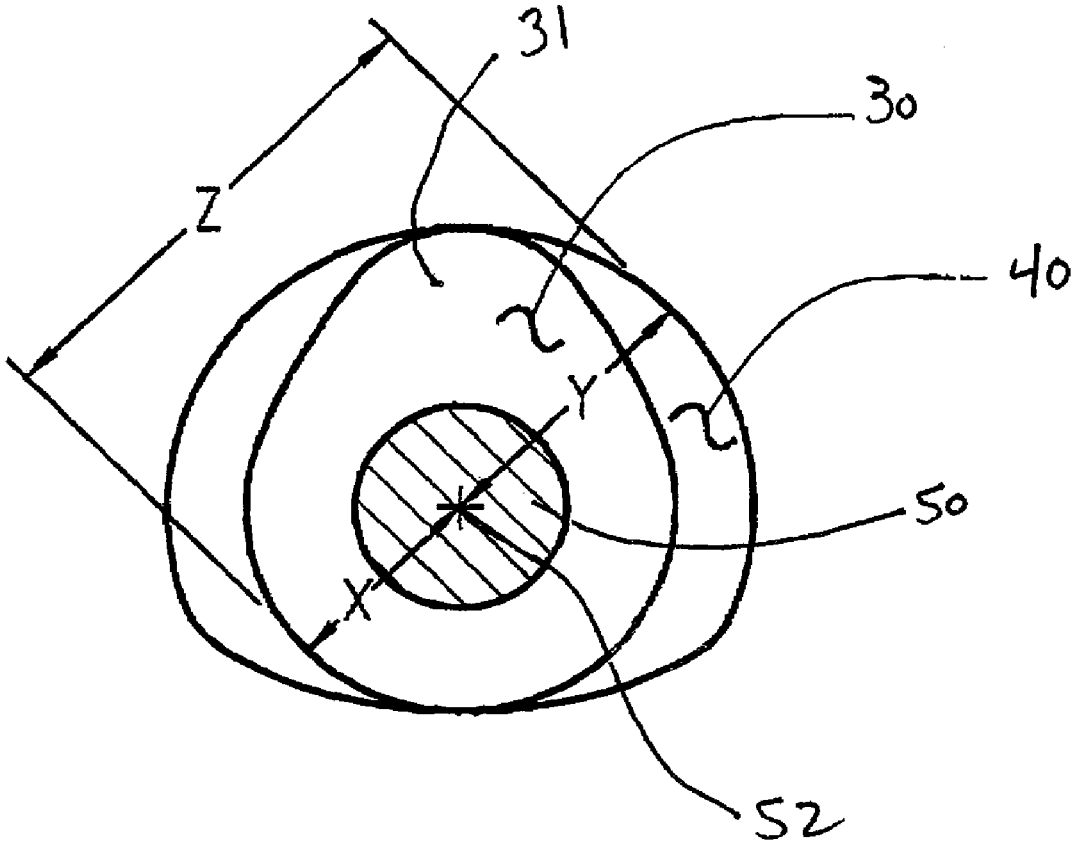
FIG. 4 is a side view of the cam shaft illustrating numerical relationship of the cam lobes in accordance to one embodiment of the present invention.

In this embodiment, the opening and closing cams work as numerical opposites (modified by where cam follower features contact the cam) so that when the opening cam 30 is opening the valve 20, the closing cam follower 42 is following the opening cam follower 32 at the same rate (and vice versa). Referring now to FIG. 4, the formula X+Y=Z describes the opening-to-closing cam relationship where X is the distance from outside edge of the opening cam 30 to the center 52 of the camshaft 50 and Y is the dimension from the camshaft centerline to the opposite edge of the closing cam 40 forming a straight line. Z is the sum of X and Y, regardless of their rotational position. The X+Y=Z formula assumes the cam follower contacts the cam at a single point collinear to the valve, camshaft center, and cam followers. Due to the shape of the cam followers, roller for the closing cam follower 42 and flat for the opening cam follower 32, the cams cannot physically contact the cam followers at a single, collinear point at all times. Therefore, the formula is modified per actual offsets based on where the cam and cam follower actually make contact.

Figure 5:
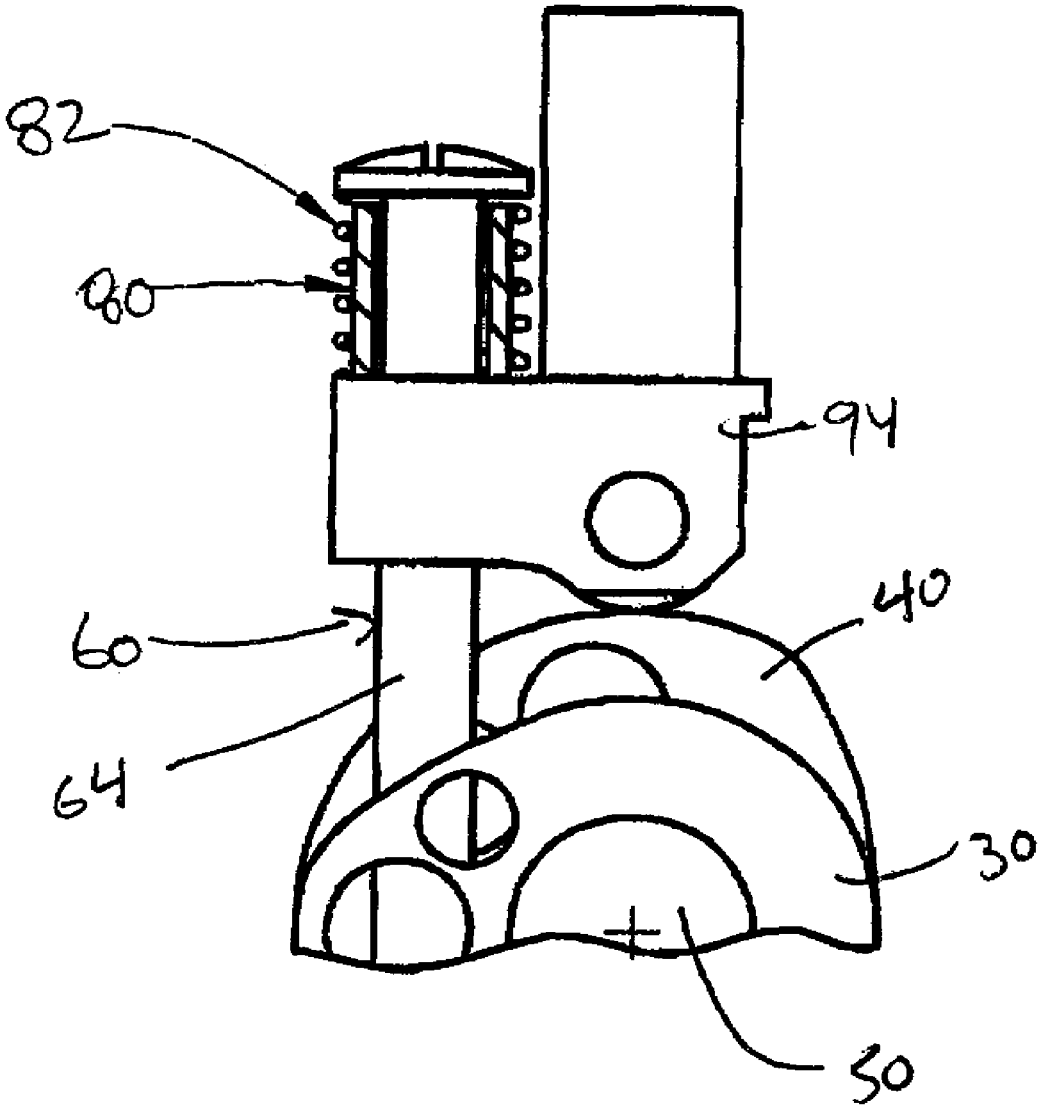
FIG. 5 is an alternative embodiment of a short spring that affects final valve closing.

The short spring 70 (FIG. 1) may be incorporated to do final sealing when the valve 20 is in the closed position. This is to override valve clearance that allows for manufacturing tolerances and thermal expansion to prevent damage to the system 10. Valve clearance is a necessary requirement of virtually all valve actuation systems. The closing cam 40 is assisted by the short spring 70 to seal the valve 20 when it is intended to be in the closed position. The short spring 70 can consist of: i) wave washer, ii) Belleville washer, iii) Belleville washer stack, iv) compression spring, or v) elastomer spring. The short spring 70 travels with closing cam follower 42 so forces do not increase with valve travel. This results in a force that is relatively light and virtually constant rather than a force that increases as the valve travels away from the closed position. To prevent valve float, travel of the spring must be limited. Referring now to FIG. 5, travel can be limited with a hard shoulder 80 or by allowing a spring 82 or pressure device to compress to a hard stop (i.e., solid height of spring member).

The present invention is distinguished from prior art in that both cam followers travel along a common centerline with respect to the camshaft center and valve as shown in FIG. 1. Forces applied to the cam followers are therefore directly in line with the forces (up and down, longitudinal) applied to the valve. Cam followers ride longitudinally on guides without being indirectly linked by rocker arms. Other methods of guiding cam follower motion include reversing the male-female relationships of the followers and guides or using a shape other than a cylinder that still allows longitudinal motion (i.e., keyed cylinder, spline, oval or rectangle).

As alternative methods of final valve closing, the following two approaches can be used in addition to, or in conjunction with the short spring: i) the closing cam profile can be modified slightly to reduce spring forces when not required (i.e., in positions where valve is not closed) and increase closing/sealing force when valve is intended to be closed, or ii) hydraulic or pneumatic pressure can be used in place of a short spring to assist in valve closing/sealing. This would consist of a pressure-fed, hydraulic or pneumatic cylinder on the tension member.

For operation of the system the measurement and adjustment of valve clearance is typically done with the engine in valve-closed position. First, in step 1: the valve clearance of the opening cam is set. Next, in step 2, the closing cam/closing cam follower is adjusted by tightening it down to zero clearance then loosening it a set amount to allow the short spring to effect final valve closing/sealing. In addition, steps 1 and/or 2 can be performed with shims and/or screw adjusters.

In one embodiment of the present invention, a roller cam 40 is used with the closing cam follower 68 and/or a flat surface cam 30 is used for the opening cam follower 32. Other variations include: i) roller cam followers for both opening and closing cams, i) flat surfaces for both the opening and closing cams, iii) domed surfaces for one or both cam followers.

A threaded, flat topped cap 34 atop the opening cam follower 32 performs the following tasks: i) actuates the valve 20 by contact with the opening cam lobe 31, ii) applies force to the valve keepers 24 to hold the valve 20 in place with respect to the opening cam follower 32, and iii) retains shims 36 to allow adjustment with respect to the cam lobe 31 and opening cam follower 32 (a.k.a., valve clearance, valve lash). The threaded cap 34 is adjustable via wrench flats or spanner wrench interfaces. Alternatively, valve keepers 24 are retained with screwed-in feature separate from the cap 34 and the cap retains shim(s) 36 and rests in place without threads and can be contained by a cylindrical overlap.

A positive means of locking the threaded cap 34, above, is required to prevent its adjustment from changing. This can include the jam or locking nut 66, a safety wire 35, locking tab or other recognized means of safely retaining a nut (FIG. 2).

Referring now to FIG. 3, as mentioned above the cam followers each have an offset flange 92 and 94, or boss, that retain or attach to the tension rod 64. The cam followers are prevented from rotating by the tension rod 64 and the fact that the arcs formed by rotating the cam followers offset at one, collinear point. Therefore, the tension rod prevents the cam followers from rotating. The offset dimensions 85 and 86 for the closing cam follower 42 and the opening cam follower 32, respectively, are illustrated in FIG. 3 and are offset from the center 88 of the tension rod 64.

Other methods of linking the cams include: i) A tension rod with a flange or connector head 68 on one end and threaded on the opposite end and a smooth bore through both cam followers offset bosses with a nut and jam nut on one end of the tension rod; ii) Two shorter tension rods, each with a flange on one end and threaded on the opposite end, one with left hand threads and the other with right hand threads. A turnbuckle member, with internal left and right hand threads would be used to join the two shorter tension rods. Both offsets in the cam follower bosses would be smooth-bored to allow the tension rods to move with respect to the cam followers. The short spring would be used on only one end of the tension rod; iii) Cam follower bosses would be joined by a cable or flexible strap. This is possible because the cam followers are only being pulled, not pushed so forces applied are in tension, not compression. With this setup, the link would not be a rigid rod. Therefore, the cam followers would need to be prevented from rotating by another means such as a spline, keyway, or flat surface external to the follower; and iv) a flat plate slotted for clearance around the cam shaft center.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

What is claimed is:

1. A valve actuation system comprising:

a poppet valve having a valve shaft;

a first cam having a lobe defined thereon and a second cam, each cam being secured on a rotatable cam shaft;

a first cam follower having a first end and a second end, said first end of the first cam follower being secured directly to a portion of the valve shaft and said second end of the first cam follower being positioned to come into contact with the lobe of the first cam, wherein during contact with said lobe, the poppet valve moves in a first direction;

a tension rod having a first end and a second end, said first end of the tension rod being secured to the second end of the first cam follower; and a second cam follower attached to the second end of the tension rod such that the second cam follower is positioned to only come into contact with the second cam, such that at least during a portion of the contact with the second cam, the second cam moves the second cam follower causing the tension rod to move the first cam follower such that the poppet valve moves in a second direction.

2. The system of claim 1 further comprising a spring positioned on the tension rod for applying a force to move the poppet valve in the second direction.

3. The system of claim 1, wherein the first and second cam followers and a centerline of the valve shaft are positioned within a single geometric plane.

4. The system of claim 1, wherein the tension member includes means to prevent rotation of the first and second cam followers.

5. The system of claim 4, wherein the means to prevent rotation is defined by having the tension member secured at one end in a first offset flange provided by the first cam follower and attached at another end in a second offset flange provided by the second cam follower.

6. The system of claim 1, wherein the first cam follower is secured to the poppet valve by a cam cap.

7. The system of claim 1 further comprising a spring positioned on the tension rod for applying a force to move the poppet valve in the second direction.

8. A valve actuation system comprising:

a poppet valve having a valve shaft;

a first cam and a second cam, each cam being secured on a rotatable cam shaft;

a first cam follower secured to the valve shaft and positioned to come into contact with a lobe defined by the first cam, such that during contact with said lobe, the poppet valve moves in a first direction;

a tension rod secured at a first end to the first cam follower and positioned substantially parallel to said valve shaft;

a second cam follower attached to a second end defined by the tension rod and positioned to come into contact with the second cam, such that during contact, the second cam follower moves said tension rod such that the poppet valve moves in a second direction;

the first cam follower includes an offset flange having an opening to receive the first end of the tension rod; and the second cam follower includes an offset flange having an opening to receive the second end of the tension rod.

9. The system of claim 8, wherein the offset flange provided by the first cam follower is threaded and the first end of the tension rod is threaded.

10. The system of claim 9, wherein a locking nut is positioned on the threaded end of the tension rod.

11. A valve actuation system having a valve that is movable from an opening position to a closing position along a valve axis, the system comprising:

an opening cam and a closing cam, each secured to a rotatable cam shaft;

an opening cam follower secured to the valve about the valve axis by a cam cap and positioned to only come into contact with the opening cam, such that during at least a portion of the contact with the opening cam the valve moves into the opening position;

a closing cam follower secured to the valve and positioned to only come into contact with the closing cam, such that during at least a portion of the contact with the closing cam the valve moves into the closing position; and a tension rod having first and second ends, the first end being secured to the opening cam follower and the second end being attached to the closing cam follower.

12. The system of claim 11, wherein the tension rod is positioned substantially parallel to said valve shaft.

13. The system of claim 11, further comprising a spring positioned on the tension rod for applying a force to move the valve in the closed direction.

14. The system of claim 11, wherein the tension member includes means to prevent rotation of the opening and closing cam followers.

15. The system of claim 14, wherein the rotation preventing means is defined by having the first end of the tension member secured in an opening defined by an offset flange provided by the opening cam follower and having the second end of the tension member slidably attached in an opening defined by an offset flange provided by the closing cam follower.

16. The system of claim 14, wherein the opening defined by the offset flange provided by the opening cam follower is threaded and the first end of the tension rod is threaded.

17. The system of claim 11 wherein the opening and closing include outside edges and wherein a distance from an outside edge of the opening cam passing through the center of the cam shaft to an outside edge of the closing cam is substantially the same during the rotation of the cam shaft.

18. A valve actuation system having a valve that is movable from an opening position to a closing position along a valve axis, the system comprising:

a tension rod having first and second ends;

a first cam follower connected to the valve, the first cam follower having a flange for connecting to said first end of said tension rod such that the tension rod is offset from and parallel to the first cam follower;

a second cam follower having a flange for slidably connecting to said second end of said tension rod such that the tension rod is offset from and parallel to the second cam follower; and a pair of cams secured to a rotatable cam shaft which when rotated, the pair of cams separately come into contact and actuate the first and second cam followers, such that the valve is moved.

* * * * *